United States Patent [19]

Kim et al.

[11] Patent Number: 4,713,548

[45] Date of Patent: Dec. 15, 1987

[54] ELECTRON ATTACHMENT APPARATUS AND METHOD

[75] Inventors: Yong W. Kim, Bethlehem, Pa.; Thomas W. Harding, Wilmington, Del.

[73] Assignee: Lehigh University, Bethlehem, Pa.

[21] Appl. No.: 796,906

[22] Filed: Nov. 12, 1985

[51] Int. Cl.[4] ..... H01J 27/24

[52] U.S. Cl. ..... 250/423 R; 250/283; 250/424; 250/427

[58] Field of Search ..... 250/427, 423 P, 424, 250/423 R, 283, 493.1, 504 R; 422/121; 55/102; 315/111.81; 313/310

[56] References Cited

U.S. PATENT DOCUMENTS 3,313,971 4/1967 Nagy ..... 313/542

4,574,004 3/1986 Schmidt-Ott et al. ..... 55/4

*Primary Examiner*—Janice A. Howell

*Assistant Examiner*—Constantine Hannaher

*Attorney, Agent, or Firm*—Ratner & Prestia

[57] ABSTRACT

Apparatus which can be used for producing negative ions in a gaseous or liquid fluid is disclosed, as well as methods of using the apparatus to determine electron attachment parameters, to identify species in the fluid, or to separate selected species from the fluid. The apparatus comprises a photoelectron emitter, including a UV light source, which can be operated in pulsed or continuous modes, and a photocathode; in addition, a radially-spaced, coaxial negative ion collector, including a negative ion receiving plate, at least one of the photocathode and the receiving plate having cylindrical configuration.

22 Claims, 5 Drawing Figures

ELECTRON ATTACHMENT APPARATUS AND METHOD

This invention is in the field of radiant energy; specifically it relates to apparatus and methods for generating molecular ions by attachment of photoelectrons to neutral molecules, as well as detecting the ions and identifying, separating, or removing selected molecules from fluid media.

Production of negative molecular ions by electron attachment is a phenomenon which occurs in electrical discharges, photochemical reactions, and other processes, primarily in the gas phase, in the vicinity of a source of slow electrons. While there are some non-attaching molecules, the overwhelming majority of molecules, including virtually all triatomic and heavier molecules, exhibit significant electron affinity and large cross-sections for electron attachment.

The attachment cross-section exhibits a dependence on the energy of the electron at the time of collision. In the case of dissociative attachment, i.e., when the collision results in fragmentation of the molecule into a negative ion and other products, there is a threshold electron energy, the dissociation energy of the molecule, below which the collision cross-section vanishes. On the other hand, direct attachment of an electron to a molecule, without fragmentation, can take place over any range of incident electron energies, so long as a third body is available to participate in conserving energy and momentum. Large attachment cross-sections can be achieved in gaseous or liquid fluids in which the particle density is relatively high. As one might expect, the direct attachment cross-section is sensitive to the composition and thermodynamic state of the host, third body medium.

Negative molecular ions, once produced in a fluid medium, respond to an applied electric field in a manner reflective of their respective mobilities, proportional to their charge/mass ratios. The drift velocities of electrons and negative molecular ions in an electric field are directly proportional to their mobilities and the field strength.

Electron attachment experiments can be used to determine the electron affinities and electron attachment cross-sections for selected atomic and molecular species. The values of these fundamental parameters are useful in the fields of ion beams, plasmas, and gas discharge devices, for example. Electron attachment apparatus and methods could also find utility in the identification and separation of components in a fluid medium by taking advantage of the different drift velocities in an electric field, due to the differences in mass, of the various species produced by electron attachment.

Two major techniques are available for the production and study of negative molecular ions. The electron beam technique employs a monoenergetic electron beam that interacts with a target fluid at low pressures, i.e., at or below 0.001 torr. However, energy resolution, difficult energy scale calibration, especially at low electron energies, and the low pressures required, leading to weak signal problems, limit the technique to measuring absolute attachment cross-sections for total ion production, without distinction by species.

The swarm technique, in which electrons generated in one of several ways are made to drift through a fluid under the influence of a uniform electric field, constitutes the second general method. However, a major difficulty is encountered in obtaining the correct electron energy distribution function, and this deficiency limits the pressures of the attaching gas species in order to avoid perturbing the electron energy distribution in the carrier gas. A number of the swarm variations require complicated analyses to obtain even the most basic attachment parameters.

Both major techniques for the production and study of negative molecular ions generally require long data gathering sessions because of low signal levels. Also, data can be gathered at only one electric field or electron energy at a time.

Thus, it is one object of the present invention to overcome the problems encountered using the known techniques for determining electron attachment parameters by providing improved instrumentation. It is another objective to provide apparatus and a method of using it which can be employed on a macroscopic scale for identifying and optionally separating the various species in a fluid medium.

In attaining these objectives this invention provides apparatus for producing negative ions in a fluid medium which includes three components: (1) a photoelectron emitter, including a UV light source and means for controlling the source, a photocathode disposed to be irradiated by the source, and means for biasing the photocathode negative with respect to a reference potential; (2) a negative ion collector in radially-spaced, coaxial relationship with the aforesaid emitter, including a receiving plate, and means for biasing the plate at a positive potential with respect to the photocathode, at least one or the other of the photocathode and the plate having cylindrical configuration; together with (3) means for introducing and retaining the fluid medium between the emitter and collector for a time sufficient to produce negative ions in the fluid medium.

Characteristic of this apparatus is the separation of electron production from electron transport. This confers the ability to operate over fluid pressures ranging from a torr or less to several atmospheres at room temperature without external heating or cooling. In the context of this invention, the term "fluid" includes liquids having suitably high bulk electrical resistivities as well as gases. The coaxial relationship between the emitter and collector elements yields an electric field which varies as $1/R$, where R is the radial distance from the axis, i.e., the field is not uniform between the electrodes.

In addition, the UV light source can be operated in a pulsed mode, continuously, or in a combination thereof. The pulsed mode is especially useful for determining electron attachment parameters or identifying species contained in the fluid. When used for thses purposes, the apparatus, in combination with certain optional features, can yield separated photoelectron and molecular ion currents in a single experiment requiring less than a second. Analysis of the detailed structures of such time-resolved currents leads to determination of the electron attachment coefficient and the energy-resolved electron attachment cross-section for a selected species in the fluid. Continuous or semi-continuous operation of the source is advantageous when it is desired to segregate or separate certain species from the fluid. The ability to operate at atmospheric or higher pressures makes these applications practical for the first time.

The apparatus of this invention may also include integral electrical shielding components which are especially desirable to improve the signal to noise ratio when attachment parameters are being measured. In addition, the apparatus optionally includes means for detecting arrival of charged particles at the receiving plate, which may utilize an amplifier network capable of detecting both photoelectron and negative ion currents. These currents typically differ a thousand-fold in magnitude. Output from the plate current amplifier can be fed into data processing hardware for computational purposes if desired.

By using the apparatus of this invention, it is possible to determine electron attachment parameters for a species in the fluid using a simple algorithm. Moreover, various species in the fluid can be identified and quantified on the basis of the measured negative ion drift velocity and integrated ion current, respectively. In addition, the apparatus is applicable to the separation of isotopes, which have different charge to mass ratios, and to the separation of very fine (diameter less than about 5 micrometers) particles from a fluid stream.

The apparatus of this invention and the method of its use will be clarified by reference to the drawings, which illustrate an embodiment of the invention which includes certain optional features, and to the detailed description which follows.

Figure 1:
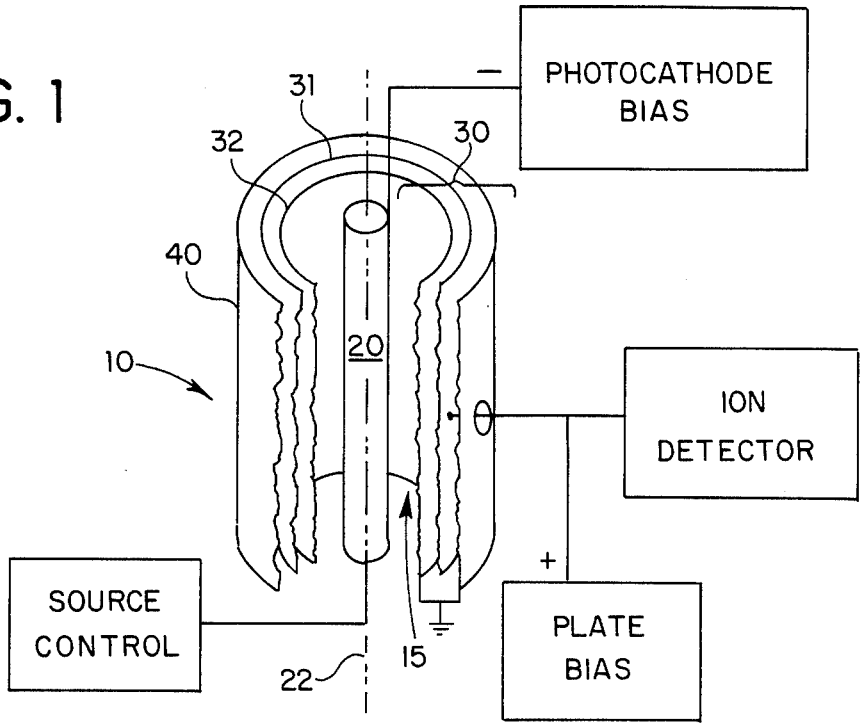
FIG. 1 is a perspective, diagramatic view of one embodiment of the electron attachment apparatus of this invention with parts broken away.
Figure 2:
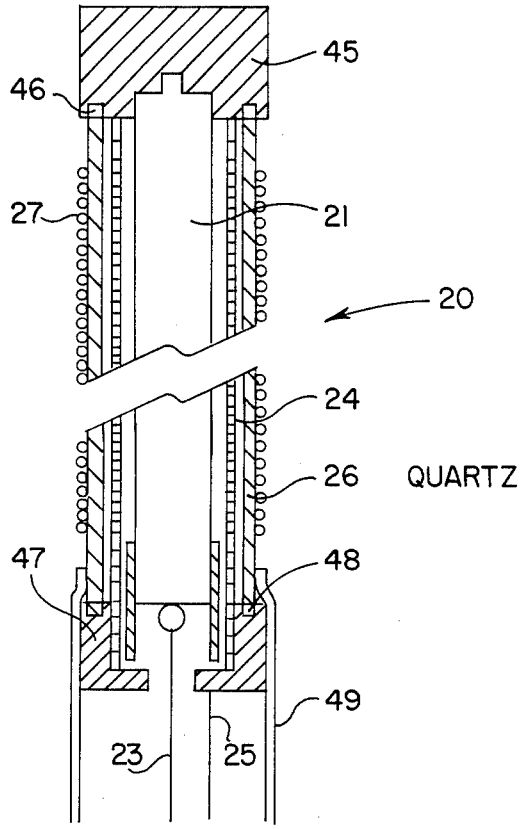
FIG. 2 is a more detailed side view in cross-section of a photoelectron emitter which may be employed in the apparatus shown in FIG. 1.
Figure 3:
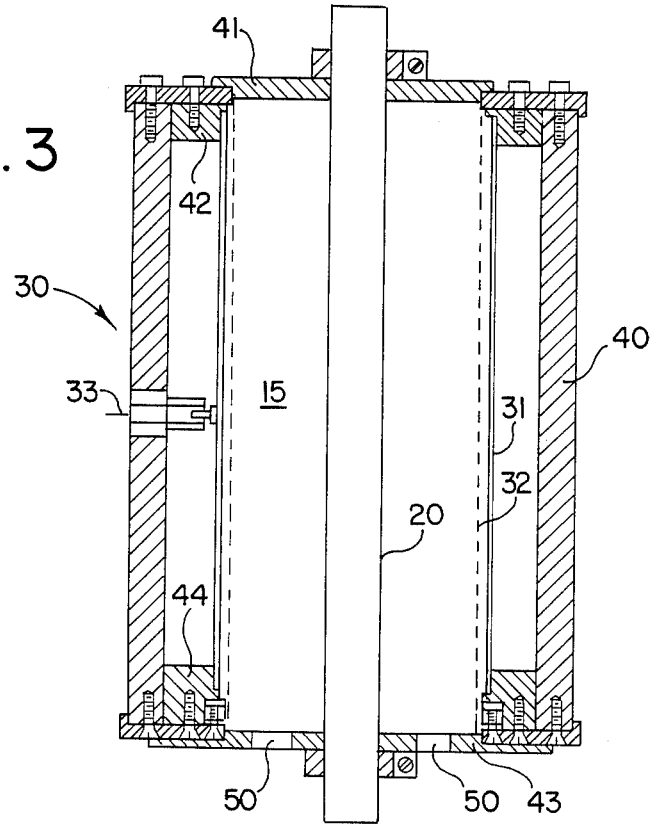
FIG. 3 is a more detailed side view in cross-section of another portion of the apparatus shown in FIG. 1 and 2.

The specific embodiment of this invention illustrated in FIGS. 1–3 is adapted for determining electron attachment parameters for a target gas such as oxygen or sulfur dioxide in an inert host gas such as helium or nitrogen. With reference first to FIG. 1, electron attachment apparatus 10, with cylindrical configuration about axis 22, includes axial photoelectron emitter 20 and negative ion collector 30 spaced radially beyond the emitter. Fluid 15 consists of the target gas, host gas mixture. The photoelectron emitter is shown in more detail in FIG. 2. The negative ion collector, including receiving plate 31, screen 32, and outer envelope 40, is illustrated in greater detail in FIG. 3. In other embodiments of the invention it may be advantageous to reverse the positions of the emitter and collector.

In any case, the photoelectron emitter includes a UV light source and means for controlling the source to emit either pulses or a continuous beam of light, or some combination thereof. The specific source control selected will depend upon the type of source and the demands placed upon it. Such controls are well known in the art. The apparatus of FIGS. 1–3, adapted for determining electron attachment parameters, employs a xenon-filled, quartz flashtube source controlled to operate in a pulsed mode, delivering a pulse of light a few microsec. long. The source control means includes a high voltage DC power supply, capacitor and spark gap in the usual configuration.

The photoelectron emitter also includes a photocathode disposed in a manner to be irradiated by the light source so as to yield free electrons by the photoelectric effect. In order to mobilize the electrons, the photocathode is biased at an electrical potential which is negative with respect to a reference potential, e.g., −50 to 200 volts with respect to ground. Thus, a DC power supply, sized to the specific apparatus and purpose, suffices as the photocathode bias.

In order to move the electrons generated at the photocathode through fluid 15, receiving plate 31 is biased at a positive potential with respect to the photocathode. The plate bias can be effected with a filtered, regulated DC power supply maintained, e.g., slightly above ground, such as about +8 volts. In apparatus employed to determine electron attachment parameters, means for detecting arrival of negative ions at receiving plate 31 is utilized in combination with the other components. The ion detecting means may be quite elaborate in this case. In other embodiments of the apparatus and for other purposes the ion detecting means may constitute a simple ammeter, indicator light, LED network, etc. The ion detecting means may be unnecessary if the apparatus is being used for macroscopic fluid processing.

With reference now primarily to FIG. 2, photoelectron emitter 20 includes UV light source 21, which may be a xenon flashtube. Light source 21 is connected to the source control described above by means of high voltage lead 23. The second electrical lead 25 may be grounded. Light source 21 is held between upper cap 45 and lower cap 47, sleeve 49 being provided to protect the leads. An electrically conducting, e.g., brass, cylindrical, coaxial discharge shield 24 connecting upper cap 45 and lower cap 47 is spaced radially beyond source 21. Shield 24 is rendered UV light-transmitting by being perforated. The perforations allow light from the source to pass through to the photocathode, but provide source discharge shielding for other electrodes.

Sheath 26, a UV-transmitting, cylindrical, coaxial member, spaced radially beyond shield 24, carries photocathode 27 and is supported between upper cap 45 and lower cap 47 in grooves containing upper O ring 46 and lower O ring 48, respectively. The photocathode may constitute a semi-transparent coating of a metal or other material having a relatively low work function. Alternatively, it may comprise a metal wire or other form, e.g., a mesh, optionally supported on a member such as sheath 26. The operational requirement is that light from source 21 irradiate the photocathode. To these ends, sheath 26 is advantageously a quartz tube and photocathode 27 is aluminum wire helically wound outwardly on the sheath. In constructing the photocathode, several longitudinal wire segments beneath the helical winding may be employed to reduce the inductance and resistance of the winding. When the winding is applied to the tube, a slight gap is preferably maintained between the individual turns, which are uniformly applied. The wire may be affixed to the sheath with an adhesive. Electrical connection is made between the photocathode and the photocathode bias described above.

As indicated in FIG. 3, photoelectron emitter 20, including the elements described immediately above, is mounted axially with respect to outer envelope 40. Envelope 40, together with upper plug 41 and lower plug 43, provide means for retaining fluid 15 between photoelectron emitter 20 and negative ion collector 30. In the illustrated embodiment, fluid ports 50 provide means for introducing the fluid, and the entire apparatus can be placed in a vacuum chamber for carefully controlling the fluid components when electron attachment parameters are being determined. In other embodiments of the apparatus intended for other purposes, different means for introducing and retaining the fluid may be provided. For example, if it is desired to utilize the apparatus to separate a given species from a fluid, fluid flow may be established through the apparatus parallel to he cylinder axis, the species of interest will become concentrated downstream according to the drift velocity of its negative ion, and a skimmer tube can be utilized to collect the enriched fluid. A number of stages can be used to progressively purify the desired species.

As illustrated in FIG. 3, negative ion collector 30 preferably includes means for shielding receiving plate 31 from space charge developed at the photocathode. Shielding can be effected by providing electrically grounded, ion-transmitting, cylindrical screen 32 coaxial with photoelectron emitter 20 and source 21 and placed radially between photocathode 27 and receiving plate 31. Although some of the ions will be collected at the screen and never reach the plate, this is not a serious impediment. The shielding effect of screen 32 is enhanced by electrical connection to a conductive outer envelope, producing a Faraday cage. Receiving plate 31 is insulated from ground with non-conducting upper spacer 42 and lower spacer 44.

Figure 4:
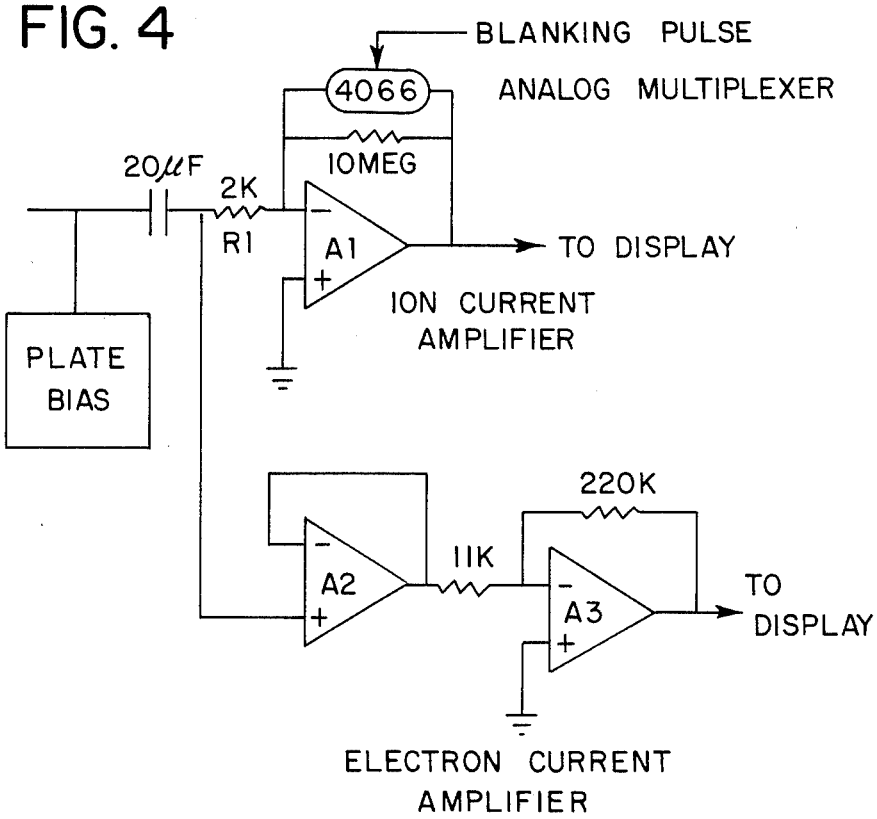
FIG. 4 is a schematic electrical circuit diagram showing a plate current amplifier network according to this invention.

Coaxial lead 33 connects receiving plate 31 to the plate bias and optional ion detector illustrated in FIG. 1 and discussed above. In the illustrated embodiment of this invention, intended for the determination of electron attachment parameters, it is preferred to employ an ion detector having a plate current amplifier network with means for switching amplifier gain automatically so as to detect both initial electron current and the subsequent ion current following a single light pulse. A particularly advantageous switching means includes an analog multiplexer, whose use in this context is shown in FIG. 4.

The gain of the amplifier is changed during the evolution of the plate current signal. The high gain of the amplifier is reduced during the initial, fast, electron-dominated part of the signal, and then the gain is increased after the electron current is over, in order to amplify the smaller ion current signal. This is accomplished with an analog multiplexer in parallel with the resistor which determines amplifier gain as shown in FIG. 4. A square trigger pulse with a duration of about 100 microsec. controls the on-off state of the switch. The trigger pulse starts when the external spark gap in the source control breaks, and it lasts for longer than the duration of the electron pulse.

The amplifiers A1, A2 and A3 are 353N BIFET operational amplifiers. The electron current is sensed by amplifying the voltage developed across R1 using the voltage follower A2 and voltage amplifier A3. Current reaching receiving plate 31 is capacitively coupled because of the plate bias supply. The trigger circuit/blanking pulse for the analog multiplexer consists of a phototransistor, which receives a light pulse when the UV light source is discharged, coupled to a LM311 comparator, 7404 hex inverter, and mutivibrator-timer which produces a pulse whose duration can be adjusted to control the analog multiplexer.

Figure 5:
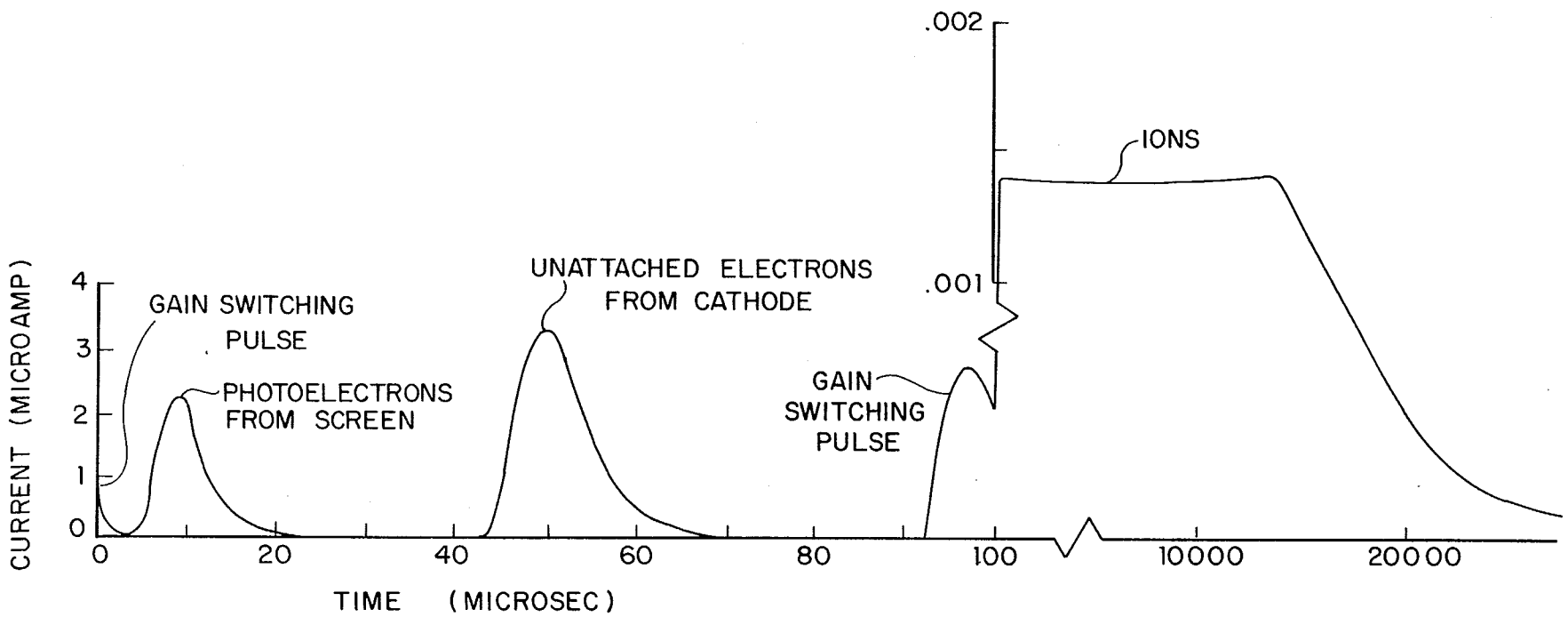
FIG. 5 is a representative graph of plate current vs. time when apparatus of this invention is operated in a pulsed mode.

A typical full plate current profile resulting from a single light pulse is shown in FIG. 5. The electron signal labeled "photoelectrons from screen" is due to the photoelectric emission of electrons from screen 32 caused by direct irradiation from the UV source reaching the screen. Utilizing profiles such as the one shown in FIG. 5, the electron attaching parameters for a fluid can be computed using algorithms available to those in the art.

The detection of electron-attaching species in a fluid is another application of the apparatus of this invention. As indicated above, molecules containing a few atoms are readily converted to their negative ions, so their presence in a fluid can be detected by the apparatus of this invention, and various species can be discriminated on the basis of their drift velocities. Specifically, the presence of polyhalogenated organic chemical compounds in a fluid can be determined. This is especially useful when the polyhalogenated organic chemical compound is selected from the anesthetics whose common names are isoflurane, enflurane, halothane, and methoxyflurane.

In a related embodiment, a method for collecting a desired negative ion species from a fluid medium carrying neutral molecules is provided for by the use of conventional means, such as a well-known skimmer tube, which serves to capture the annularly stratified ion-enriched part of the fluid and separate it from the remainder of the fluid. The conventional skimmer tube comprises an annular fluid flow segment adapted to capture an annularly stratified segment of fluid flowing through it.

It will be evident that a number of obvious variations in the apparatus of this invention and the methods of its use can be made which embody its novel features. It is intended that these variations be included within the scope of this invention as embraced by the following claims:

What is claimed is:

1. Apparatus for producing negative ions in a fluid medium which comprises a photoelectron emitter, including a UV light source and means for controlling said source, a photocathode disposed to be irradiated by said source, and means for biasing said photocathode negative with respect to a reference potential;

a negative ion collector in radially-spaced, coaxial relationship with said emitter, including a receiving plate, and means for biasing said plate at a positive potential with respect to said photocathode, at least one of said photocathode and said plate having cylindrical configuration; together with means for introducing and retaining the fluid medium between said emitter and said collector for a time sufficient to produce negative ions in the fluid medium.

2. The apparatus of claim 1 wherein said light source is encircled by an ultraviolet light-transmissive sheath and said photocathode is mounted on said sheath.

3. The apparatus of claim 2 wherein said photocathode consists of aluminum wire winding.

4. The apparatus of claim 1 wherein said photocathode and said plate both have cylindrical configurations, and the diameter of said plate is greater than the diameter of said photocathode.

5. The apparatus of claim 1 wherein said negative ion collector further comprises means for shielding said plate from space charge developed at said photocathode.

6. The apparatus of claim 5 wherein said plate shielding means includes an ion-transmitting, electrically grounded screen between said photocathode and said plate.

7. The apparatus of claim 1 wherein said negative ion collector further comprises means for detecting arrival of negative ions at said plate.

8. The apparatus of claim 7 wherein said light source control means produces a light pulse when activated.

9. The apparatus of claim 8, wherein said ion collector means includes a plate current amplifier network with means for switching amplifier gain automatically, so as to permit detection of both initial electron current and subsequent ion current resulting from a single light pulse.

10. The apparatus of claim 9 wherein said amplifier gain switch means includes an analog multiplexer.

11. The apparatus of claim 1 wherein there is included means for biasing both said photocathode and said receiving plate negative, and means for activating intermittently the light source, such that the negative ion species is separated from the neutral molecules by reference to the drift velocity of said species during the residence time of the species in the apparatus.

12. The apparatus of claim 11 wherein means is provided for directing a part of the fluid medium which is enriched with negative ion species separately from the remainder of the medium for collection of the negative ion-rich fluid.

13. Apparatus for producing negative ions in a gas which comprises (A) a photoelectron emitter, including (1) an elongated UV light source defining the axis of a cylinder; (2) means for controlling said source to produce pulsed light; (3) a UV transmitting, cylindrical, coaxial, electrically grounded discharge shield spaced radially beyond said source; (4) a UV transmitting, cylindrical, coaxial sheath spaced radially beyond said shield; (5) a metallic wire photocathode helically wound outwardly on said sheath; and (6) means for biasing said photocathode negative with respect to a reference potential;

(B) a negative ion collector, including (1) a cylindrical, coaxial receiving plate spaced radially beyond said photocathode; (2) an electrically grounded, ion-transmitting, cylindrical screen coaxial with said source between said photocathode and said plate; (3) means for biasing said plate at a positive potential with respect to said photocathode; and (4) means for detecting arrival of negative ions at said plate, which means includes a plate current amplifier network utilizing an analog multiplexer to switch amplifier gain automatically, so as to permit detection of both initial electron current and subsequent ion current resulting from a single light pulse; together with (C) means for introducing and retaining the gas between said emitter and said collector for a time sufficient to produce negative ions in the gas.

14. A method for producing negative ions in a fluid medium which comprises (1) introducing the fluid into apparatus which contains a photoelectron emitter, including a UV light source and means for controlling said source, a photocathode disposed to be irradiated by said source, and means for biasing said photocathode negative with respect to a reference potential;

a negative ion collector in radially-spaced, coaxial relationship with said emitter, including a receiving plate, and means for biasing said plate at a positive potential with respect to said photocathode, at least one of said photocathode and said plate having cylindrical configuration; together with means for introducing and retaining the fluid medium between said emitter and said collector for a time sufficient to produce negative ions in the fluid medium;

(2) biasing said photocathode and said plate; and (3) activating said light source.

15. The method of claim 14 wherein said negative ion collector further comprises means for detecting arrival of negative ions at said plate.

16. The method of claim 15 wherein said light source control means produces a light pulse when activated.

17. The method of claim 16 wherein said ion detecting means includes a plate current amplifier network with means for switching amplifier gain automatically, so as to permit detecting both initial electron current and subsequent ion current resulting from a single light pulse.

18. The method of claim 17 wherein said amplifier gain switch means includes an analog multiplexer.

19. The method of claim 18 wherein said fluid medium is a gas.

20. The method of claim 19 wherein said gas contains at least one polyhalogenated organic chemical compound.

21. The method of claim 20 wherein said polyhalogenated organic chemical compound is selected from the group consisting of isoflurane, enflurane, halothane, and methoxyflurane.

22. A method for collecting a desired negative ion specie from a fluid medium containing said specie, according to the charge to mass ratio of said specie, which comprises (1) introducing said fluid medium into apparatus which contains a photoelectron emitter, including a UV light source and means for controlling said source to provide irradiation, a photocathode disposed to be irradiated by said source, and means for biasing said photocathode negative with respect to a reference potential a negative ion collector in radially-spaced, coaxial relationship with said emitter, including a receiving plate, means for biasing said plate at a positive potential with respect to said photocathode, and means for detecting arrival of negative ions at said plate, at least one of said photocathode and said plate having cylindrical configuration together with means for maintaining a flow of the fluid medium between said emitter and said collector for a time sufficient to produce said negative ion specie in the fluid medium;

(2) biasing said photocathode and said plate; and (3) activating said light source;

such that said negative ion specie is separated, as an annularly stratified segment of said fluid flow, by reference to the drift velocity of said desired specie during the residence time of said negative ion specie in said apparatus; and (4) collecting said negative ion specie-rich segment by means of a tube adapted to capture said negative ion-rich annularly stratified segment of said fluid.

* * * * *